US008375602B2

(12) United States Patent
Takada et al.

(10) Patent No.: US 8,375,602 B2
(45) Date of Patent: Feb. 19, 2013

(54) SHOE HAVING LACE FITTING STRUCTURE

(75) Inventors: Yasuyuki Takada, Kobe (JP); Fumitaka Kamifukumoto, Kobe (JP); Kiyomitsu Kurosaki, Kobe (JP)

(73) Assignee: Asics Corporation, Kobe (JP)

( * ) Notice: Subject to any disclaimer, the term of this patent is extended or adjusted under 35 U.S.C. 154(b) by 436 days.

(21) Appl. No.: 12/734,139

(22) PCT Filed: Oct. 19, 2007

(86) PCT No.: PCT/JP2007/070445

§ 371 (c)(1),
(2), (4) Date: Apr. 13, 2010

(87) PCT Pub. No.: WO2009/050819

PCT Pub. Date: Apr. 23, 2009

(65) Prior Publication Data

US 2010/0205832 A1 Aug. 19, 2010

(51) Int. Cl.
*A43C 11/00* (2006.01)

(52) U.S. Cl. ..... 36/50.1

(58) Field of Classification Search ..... 36/50.1, 36/88, 91, 50.5

See application file for complete search history.

(56) References Cited

U.S. PATENT DOCUMENTS

| | | | | |
|---|---|---|---|---|
| 3,323,232 | A * | 6/1967 | Danowsky | 36/91 |
| 4,811,500 | A * | 3/1989 | Maccano | 36/91 |
| 5,167,084 | A | 12/1992 | Flammier | |
| 5,704,138 | A | 1/1998 | Donnadieu | |
| 5,940,990 | A * | 8/1999 | Barret | 36/55 |
| 5,966,841 | A * | 10/1999 | Barret | 36/50.1 |
| 5,992,057 | A * | 11/1999 | Monti | 36/89 |
| 6,367,169 | B1 * | 4/2002 | Barret | 36/51 |
| 6,505,424 | B2 * | 1/2003 | Oorei et al. | 36/129 |
| 6,701,644 | B2 * | 3/2004 | Oorei et al. | 36/129 |
| 7,159,340 | B2 * | 1/2007 | Borsoi | 36/50.1 |
| 2005/0126043 | A1 | 6/2005 | Reagan et al. | |
| 2005/0183288 | A1 * | 8/2005 | Hull | 36/54 |
| 2006/0162190 | A1 * | 7/2006 | Nishiwaki et al. | 36/97 |
| 2009/0090029 | A1 * | 4/2009 | Kishino | 36/116 |

FOREIGN PATENT DOCUMENTS

| | | |
|---|---|---|
| EP | 0329392 | 8/1989 |
| JP | 2-3291 | 1/1990 |
| JP | 02-005903 | 1/1990 |
| JP | 04-044701 | 2/1992 |
| JP | 06-078801 | 3/1994 |
| JP | 09-065908 | 3/1997 |
| JP | 3038156 | 3/1997 |
| JP | 2005-143953 | 6/2005 |

OTHER PUBLICATIONS

International Search Report of the International Searching Authority mailed Jan. 29, 2008, issued in connection with International Patent Appln. No. PCT/JP2007/070445 (2 pages).

* cited by examiner

*Primary Examiner* — Marie Patterson
(74) *Attorney, Agent, or Firm* — Mintz, Levin, Cohn, Ferris, Glovsky and Popeo, P.C.

(57) ABSTRACT

A shoe having a lace fitting structure of the present invention includes, as its primary components, a first side panel 51 extending in an upward or diagonally upward direction along a medial side surface in a space inside a main upper 2M so as to wrap around the medial side surface of the foot, and a second side panel 52 extending in an upward or diagonally upward direction along a lateral side surface in the space inside the main upper so as to wrap around the lateral side surface of the foot, and a third eyelet 23 provided at a tip of each of the first and second side panels 51 and 52, shoelace means passing through and engaging with the third eyelets.

22 Claims, 15 Drawing Sheets

SHOE HAVING LACE FITTING STRUCTURE

TECHNICAL FIELD

The present invention relates to a lace fitting structure of footwear.

BACKGROUND ART

A shoe suitable for walking or running up and down a mountain protects the foot from collisions with external objects and protects the foot from a sprain on a slope or a rough terrain. Therefore, a shoe of this type has an upper with a higher rigidity as compared with an ordinary shoe.

An upper with a high rigidity increases the force and the time required for lacing and makes it difficult to evenly distribute the tightening force. In view of such a problem, various lacing structures have been proposed in the art.

First Patent Document: Japanese Laid-Open Patent Publication No. 6-78801

Second Patent Document: U.S. Pat. No. 5,167,084

Third Patent Document: Japanese Laid-Open Patent Publication No. 2-903

Fourth Patent Document: Japanese Laid-Open Patent Publication No. 2005-143954

Fifth Patent Document: US 2005/0126043 A1

DISCLOSURE OF THE INVENTION

Shoes disclosed in Japanese Laid-Open Patent Publication No. 6-78801 and U.S. Pat. No. 5,167,084 each include an internal tightening device. With this shoe, it is necessary to separately do the tightening of the shoe itself and the tightening of the internal tightening device.

A shoe disclosed in Japanese Laid-Open Patent Publication No. 2-5903 includes a stirrup for supporting the heel and the navicular bone. However, the stirrup of this shoe does not support the medial cuneiform bone. Moreover, it would not be possible to tighten the stirrup and the main upper with different tightening forces, or to selectively tighten these members.

A shoe disclosed in Japanese Laid-Open Patent Publication No. 2005-143954 includes a belt connected to the sole. The belt is placed outside the main upper.

With this shoe, it would be possible to achieve the sense of unity between the sole and the main upper. However, it would not be possible to tighten the belt and the main upper with different tightening forces, or to selectively tighten these members.

A boot disclosed in US 2005/0126043 A1 includes two independent lacing zones. The shoelace of each zone is separately pulled to fit the upper of the boot to the foot in that zone. This boot requires two independent shoelaces.

A main object of the present invention is to provide a shoe that can be laced up quickly and selectively with a different tightening force depending on the portion of the foot.

A shoe of the present invention is a shoe having a lace fitting structure, including: a sole for absorbing an impact of landing, an upper for wrapping around an instep, and shoelace means for fitting the upper to the instep, wherein the upper includes (defines) a first opening through which a leg comes out in an upward direction when worn, and a second opening provided toward a forward direction of the first opening, the two openings being continuous with each other in a front-rear direction, the upper including as its primary components: a main upper covering a medial side surface, a lateral side surface, a toe and a back surface of a foot; a plurality of first eyelets provided along a side edge of the second opening, the shoelace means passing through and engaging with the plurality of first eyelets, the plurality of first eyelets including at least one first eyelet placed near the toe around the second opening and at least one first eyelet placed near an ankle around the second opening; a plurality of second eyelets provided along the side edge of the second opening, the shoelace means passing through and engaging with the plurality of second eyelets, the plurality of second eyelets being placed between the at least one first eyelet near the toe around the second opening and the at least one first eyelet near the ankle around the second opening; a first side panel extending in an upward or diagonally upward direction along the medial side surface in a space inside the main upper so as to wrap around the medial side surface of the foot; a second side panel extending in an upward or diagonally upward direction along the lateral side surface in the space inside the main upper so as to wrap around the lateral side surface of the foot; and a third eyelet provided at a tip of each of the first and second side panels, the shoelace means passing through and engaging with the third eyelets, wherein a common requirement is that at least an upper portion of each side panel is not attached to the main upper.

In the present invention, the space inside the main upper means a space defined by the main upper, referring to a space inside of the exterior material of the main upper, and includes the space between the interior material and the exterior material where the interior material exists. Therefore, where the main upper includes the exterior material and the interior material, each panel may be placed between the interior material and the exterior material. That is, the present invention encompasses cases where each panel contacts the side surface or the instep of the foot via the interior material therebetween. The panel may be formed by the interior material.

In a shoe that includes such primary components and satisfies the common requirement, each panel is in contact with the side surface of the foot in the space inside the main upper. Therefore, each panel is placed between the exterior material and the foot, and each panel directly fits to the side surface or the instep of the foot in the absence of the high-rigidity exterior material of the main upper therebetween, i.e., with no exterior material interposed between the foot and the panel.

Moreover, since the upper portion of each panel is not attached to the main upper, the upper portion of each panel can easily move separately from the main upper. Therefore, the upper portion of each panel is not prevented from lying along the side surface or the instep of the foot.

As a result, the upper portion of the panel easily fits to the foot.

In the present invention, "along the medial (lateral) side surface of the foot" means being generally parallel to the medial (lateral) side surface of the foot.

An "eyelet" as used herein refers to a hole which the shoelace means passes through and engages with, and it is formed by, for example, providing a through hole in the main upper, providing a ring in the through hole, or using a U-shaped metal part. Note that it is not always necessary to separately provide an eyelet on the side panel, but the shoelace means may pass through and engage with the side panel itself. For example, the shoelace means may pass through and engage with a fold-back portion (loop portion) of a folded side panel.

One embodiment of the present invention is directed to a shoe including the primary components, wherein a frictional force between the shoelace means and the second eyelet is smaller than a frictional force between the shoelace means and the first eyelet, the shoelace means including: a first portion passing through the first and second eyelets so as to repeatedly reciprocate between the medial side surface and the lateral side surface without passing through the third eyelets, thereby reducing (narrowing) the second opening in a foot breadth direction and fitting the main upper to the foot; and a second portion extending from the at least one first eyelet near the toe around the second opening to pass through the third eyelets of both side panels without passing through the intermediate second eyelets and further through the at least one first eyelet near the ankle around the second opening, thereby fitting the first and second side panels to side surfaces of the foot.

In this embodiment, the first portion of the shoelace means does not pass through the third eyelet provided on each panel but passes through the first eyelets and the second eyelets to thereby fit the main upper to the foot. On the other hand, the second portion of the shoelace means does not pass through the second eyelets provided between the first eyelet near the toe and the first eyelet near the ankle but extends (passes through) from the first eyelet near the toe to pass through the third eyelets and further through the first eyelet near the ankle, thereby fitting each panel to the instep.

Since the frictional force between the first eyelet and the shoelace means is large, the tightening force of the first portion and the tightening force of the second portion can be controlled to different magnitudes. Therefore, the main upper and the panel can be fitted to the foot with different tightening forces from each other, and can be laced selectively.

In another embodiment of the present invention, the third eyelet of the first side panel and the third eyelet of the second side panel are diagonally opposing each other across a virtual line therebetween extending in a foot length direction; and the shoelace means passes continuously through the third eyelet of the first side panel and the third eyelet of the second side panel.

In this embodiment, the shoelace means passes continuously through the plurality of third eyelets diagonally opposing each other, and the third eyelets can therefore be moved toward the medial-lateral center of the foot by applying a tension on the shoelace means. Thus, the side panels fit to the instep.

Note that the second opening is typically closed by the tongue.

In still another embodiment of the present invention, the first and second side panels are in contact with an inner surface of the main upper; a lower portion of each of the first and second side panels is in contact with an arch of the foot; an upper portion of each of the first and second side panels is placed between the tongue and the main upper; and the third eyelets are exposed on the tongue, extending in an upward direction from the second opening (exposed on the tongue in the second opening so as to be seen from above).

On the upper surface of the instep, there are tendons for flexing toes. The compression of these tendons likely results in a pain and inhibits smooth flexing of the toes.

According to this embodiment, since the upper portions of the panels and the third eyelets are placed on a soft tongue, the tendons are unlikely to be compressed when the panels are tightened with a large tightening force. Therefore, the panel fits to the instep via the tongue therebetween with a soft contact between the panels and the tendons.

Since the panels are in contact with the inner surface of the main upper and with the arch, the panels can contact the foot with a different force from that with the main upper.

In this embodiment, "the panels are in contact with the inner surface of the main upper and with the arch" means that the panels are placed between the arch of the foot and the exterior material of the main upper, and in a case where the interior material exists, the panels are placed between the interior material and the exterior material so that the panels are in contact with the arch via the interior material therebetween.

In another embodiment of the present invention, the main upper includes an interior material covering at least a rear foot portion of the foot and being in contact with a foot surface, and an exterior material covering an entirety (the whole) from the foot toe to the rear foot portion and covering the interior material from outside; each side panel is placed in an inner space formed by the exterior material, and is tightened by the shoelace means when worn so as to be in contact with the foot surface via the interior material in the absence of the exterior material therebetween; and the shoe further includes: first restriction means for restricting the tightening of the first side panel on the medial arch by means of the shoelace means when worn; and second restriction means for restricting the tightening of the second side panel on the lateral arch by means of the shoelace means when worn.

In this embodiment, since each side panel is in contact with the foot surface via the interior material in the absence of the exterior material therebetween, each side panel can be fitted to the foot separately from the exterior material. On the other hand, since each side panel is fitted to the foot via the interior material therebetween, it is possible to realize a soft feel on the foot.

Moreover, each restriction means can prevent the side panel from contacting the foot too hard.

In each of the embodiments, a lower end of each side panel may be bonded (attached) to the main upper and/or the sole.

The lower end of the panel may be bonded (attached) to the main upper, or bonded (attached) to the sole with or without the main upper interposed therebetween. In such a case, the panel may roll up from the sole along a side surface of the foot.

In each of the embodiments, an upper portion of a front edge of each side panel and an upper portion of a rear edge of each side panel may not be attached to the main upper, and a lower portion of the rear edge and/or a lower portion of the front edge of each side panel may be attached to the main upper.

In such a case, since at least one of the lower portion of the rear edge and the lower portion of the front edge of the panel is attached to the main upper, the panel is bound to the main upper, and it is therefore possible to prevent the panel from contacting the foot too hard, particularly from contacting the arch of the foot too hard.

In each of the embodiments, it is preferred that the interior material and the exterior material together form a sack-like first sack portion where the interior material and the exterior material are not surface-attached to each other in an area of the medial side surface of the foot, and a sack-like second sack portion where the interior material and the exterior material are not surface-attached to each other in an area of the lateral side surface of the foot; the first and second sack portions have first and second slits, respectively, through which the inner space is exposed; the first sack portion accommodates a lower portion of the first side panel, with an upper portion of the first side panel coming out of the first slit; and the second sack portion accommodates a lower portion of the second side panel, with an upper portion of the second side panel coming out of the second slit.

In such a case, with the front end and the rear end of each slit, it is possible to prevent the panel from shifting in the front-rear direction.

When fitting the panel to the foot, the interior material prevents the lower portion of the panel from moving toward the center of the foot. Therefore, it is possible to prevent the lower portion of the side panel from contacting the foot too hard.

In each of the embodiments, neither a front edge nor a rear edge of the side panel may be attached to the main upper.

In such a case, since the panel is not bound to the main upper, the panel can be fitted hard to the foot. This embodiment is suitable for short-distance races, etc., where the shoes are worn over a short period of time.

In the present invention, the shoelace means includes one or a plurality of shoelaces. In the case of one shoelace, the structure of the shoe will be simple.

In each of the embodiments, it is preferred that the third eyelets are provided so as to lie above the tongue and below the first portion of the shoelace means when tightened; and the second portion of the shoelace means passes below the first portion of the shoelace means.

In such a case, since the second portion, shorter than the first portion, is placed below, it is easy to change the tightening of the shoelace.

In each of the embodiments, the first side panel may cover at least a portion of a medial cuneiform bone in an area in a forward direction of a navicular bone; and the second side panel may cover the foot at least one of a position facing the first side panel, a position forward thereof and a position backward thereof. That is, the second side panel may cover at least one of the base of the fifth phalanx, the shaft thereof and the cuboid bone.

As the first side panel covers the medial cuneiform bone, the medial arch of the foot is covered by the first side panel.

DESCRIPTION OF THE REFERENCE NUMERALS

Figure 1:
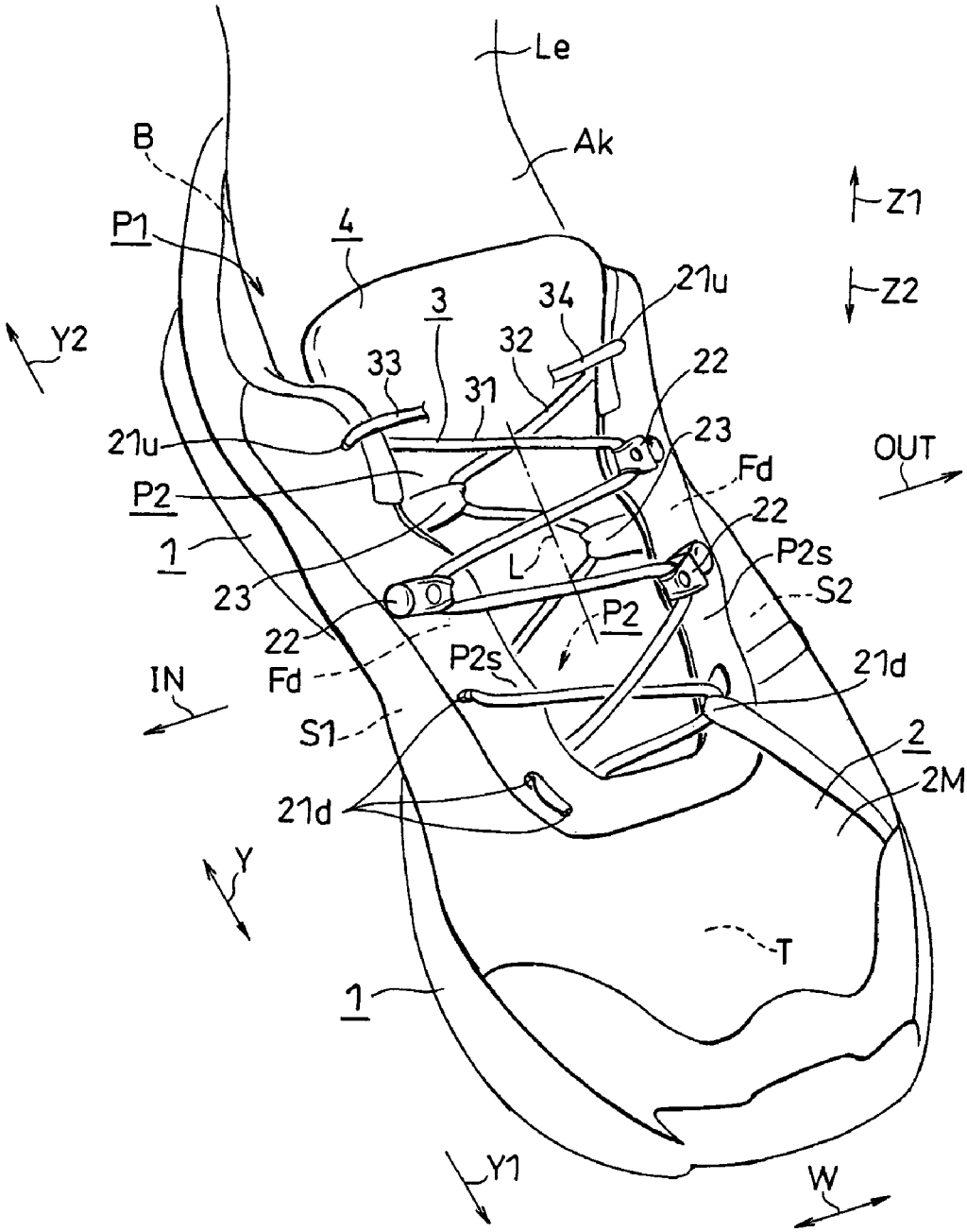
FIG. 1 is a schematic perspective view showing a shoe having a lace fitting structure according to a first embodiment of the present invention.

1: Sole
10A: First restriction means
10B: Second restriction means
11: Interior material
12: Exterior material
13A: First sack portion
13B: Second sack portion
14A: First slit
14B: Second slit
2: Upper
25: Attachment member
2M: Main upper
3: Shoelace
31: First portion
32: Second portion
33: Third portion
34: Fourth portion
21*d*, 21*u*: First eyelet
22: Second eyelet
23: Third eyelet
5*a*: Front edge
5*b*: Rear edge
51: First side panel
52: Second side panel
100: Upper portion
101: Lower portion
4: Tongue
Ak: Ankle
B: Back surface
B$5_1$: Medial cuneiform bone
B6: Navicular bone
Fd: Instep
Le: Leg
P1: First opening
P2: Second opening
P2*s*: Side edge
S1: Medial side surface
S2: Lateral side surface
T: Toe
W: Width direction
Y1: Forward direction
Y2: Rearward direction
Z1: Upward direction

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

First Embodiment

A first embodiment of the present invention will now be described with reference to FIGS. 1 to 9.

A shoe for the left foot will be illustrated in the following description. In the following figures, the arrow OUT represents the lateral side direction of the shoe, and the arrow IN represents the medial side direction of the shoe.

General Structure of Shoe:

A shoe having a lace fitting structure shown in FIG. 1 includes a sole 1, an upper 2, a shoelace 3, and a tongue 4.

The sole 1 is for absorbing an impact of landing. The upper 2 is for wrapping around the instep. The shoelace 3 is for fitting the upper 2 to the instep. The tongue 4 is for covering the instep.

Figure 2:
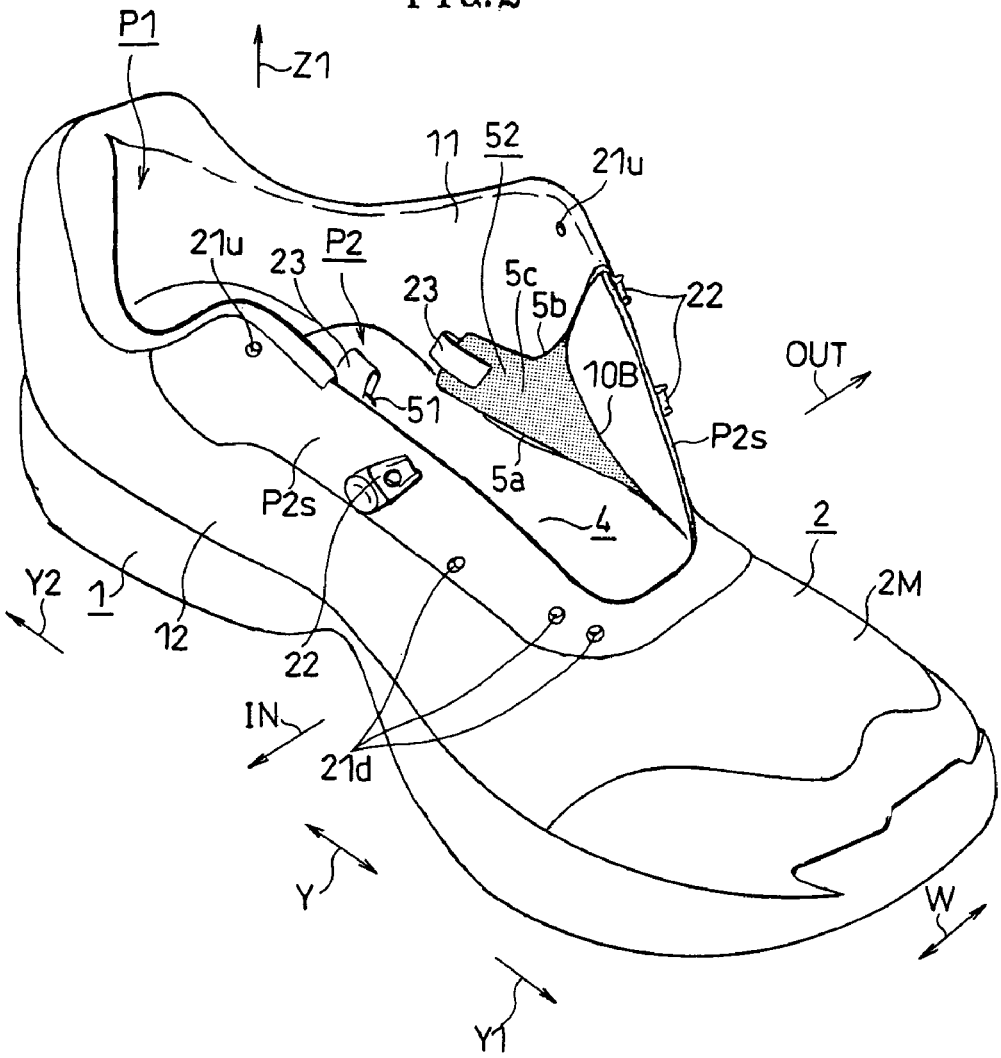
FIG. 2 is a schematic perspective view showing the shoe with shoelace means taken off.
Figure 3:
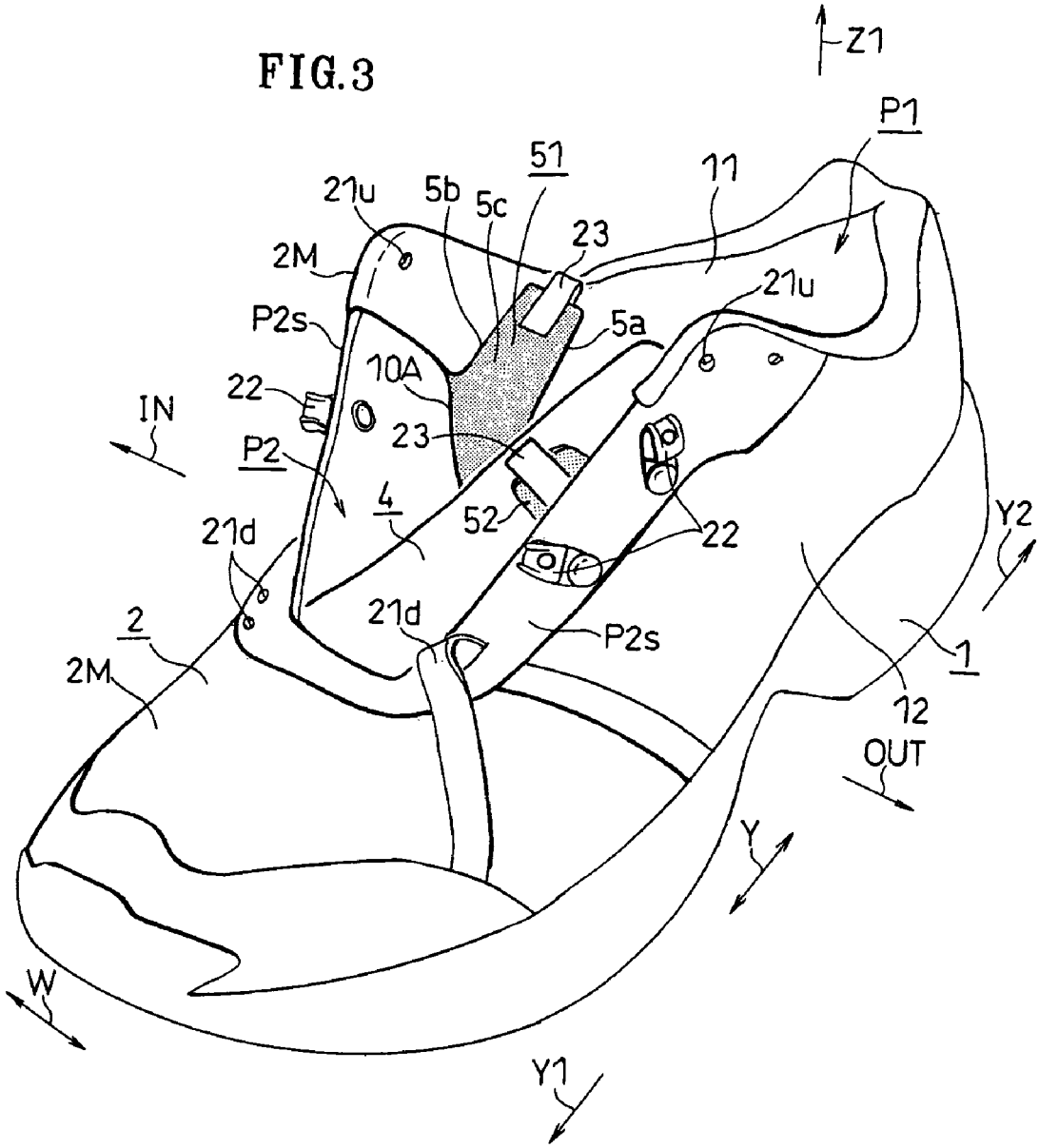
FIG. 3 is a schematic perspective view showing the shoe with shoelace means taken off.
Figure 4:
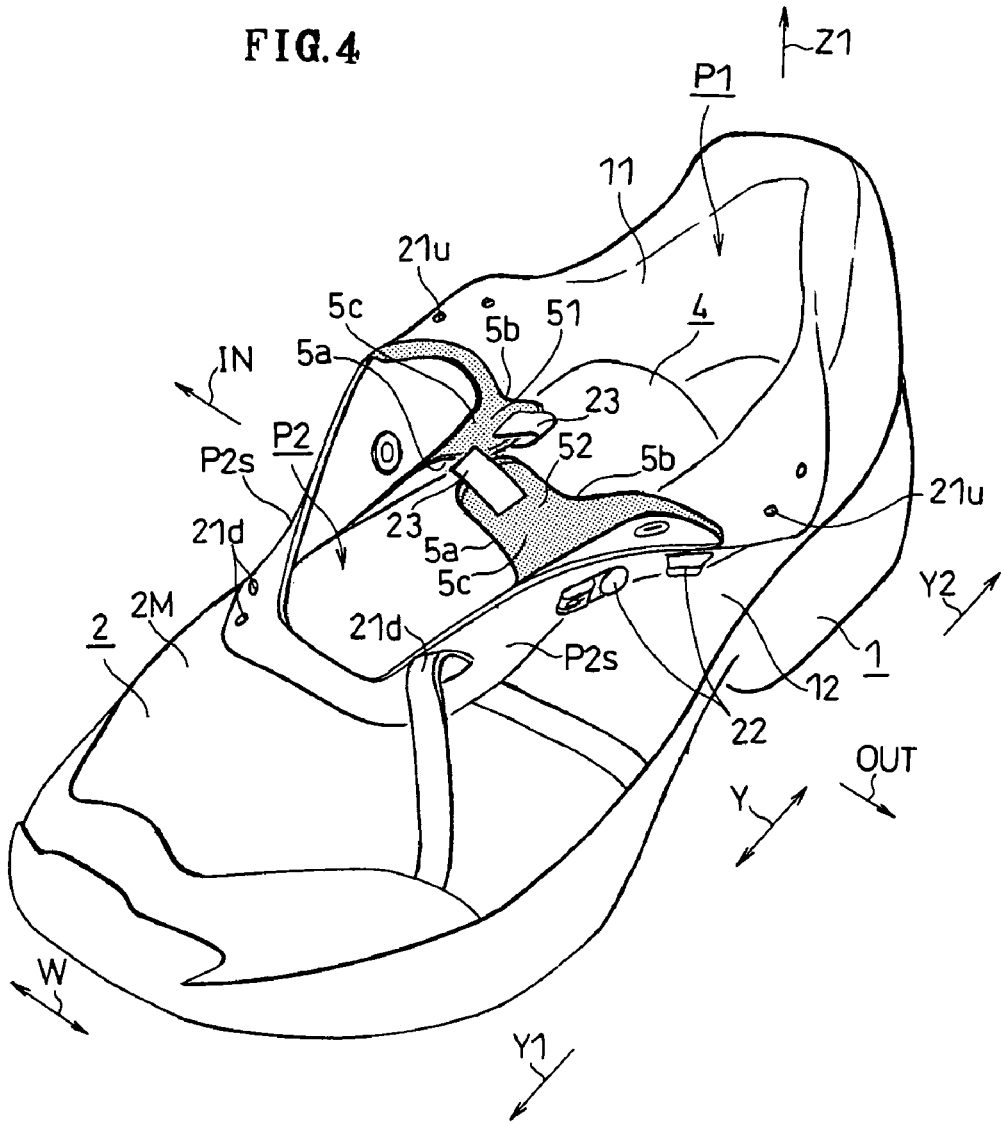
FIG. 4 is a schematic perspective view showing the shoe with shoelace means taken off.

As shown in FIGS. 2, 3 and 4, the upper 2 has a first opening P1 and a second opening P2. As shown in FIG. 1, the first opening P1 is an opening through which a leg Le comes out in the upward direction Z1 when worn.

Figure 5:
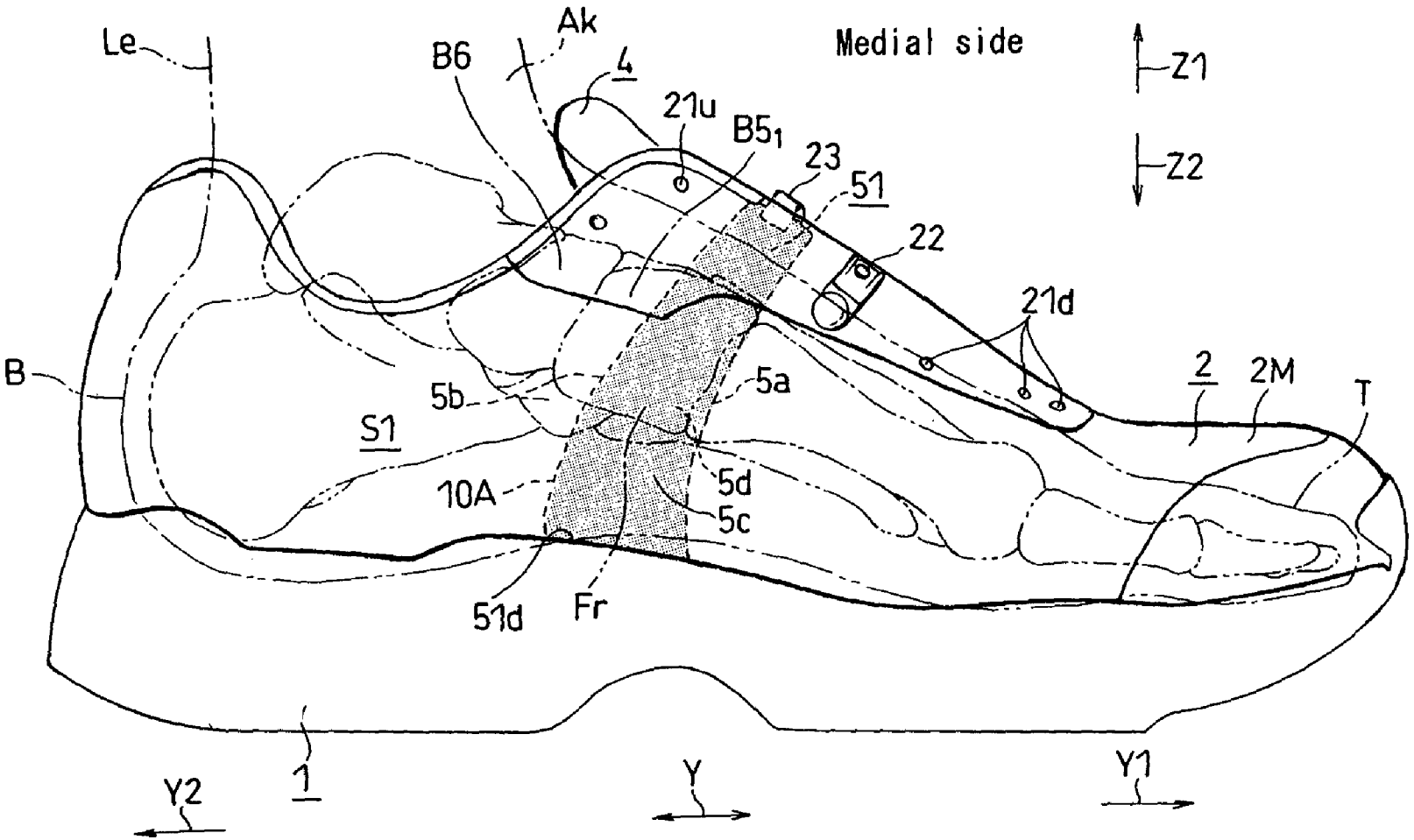
FIG. 5 is a schematic side view showing the shoe with shoelace means taken off, as viewed from the medial side.

As shown in FIG. 2, the second opening P2 is an opening provided on front of the first opening P1 being toward the forward direction Y1, i.e., toward the toe T (FIG. 5). The second opening P2 is provided in an upper portion of the upper 2, elongated in the foot length direction (front-rear direction) Y. The two openings P1 and P2 are continuous with each other. As shown in FIG. 1, the tongue 4 closes the second opening P2 from underneath (the downward direction Z2).

Figure 6:
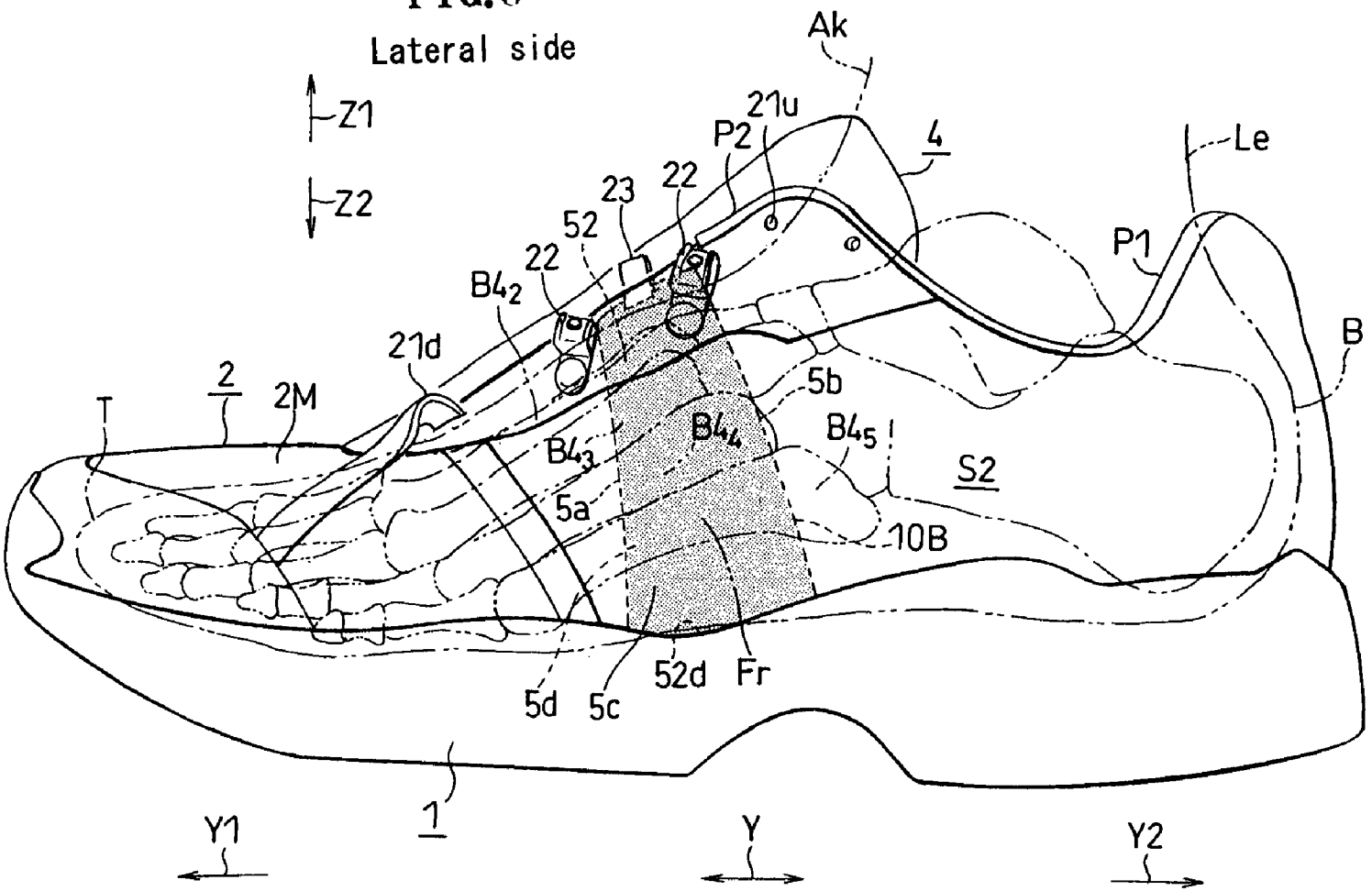
FIG. 6 is a schematic side view showing the shoe with shoelace means taken off, as viewed from the lateral side.

Upper 2:

In FIG. 3, the upper 2 includes a main upper 2M, eyelets 21*d*, 21*u*, 22 and 23, and side panels 51 and 52 (FIGS. 5 and 6).

Main Upper 2M:

The main upper 2M covers a medial side surface S1 of the foot of FIG. 5, a lateral side surface S2 of FIG. 6, a toe T, and a back surface B. The first opening P1 and the second opening P2 are formed in the main upper 2M.

The main upper 2M of FIG. 2 includes an interior material 11 and an exterior material 12. The interior material 11 covers the area from the rear foot portion to the arch, and is in contact with the foot surface. The exterior material 12 is provided on the outside of the interior material 11 and covers the entire foot.

Eyelets 21*d*, 21*u*, 22 and 23:

The eyelets include first eyelets 21*d* and 21*u*, second eyelets 22 and third eyelets 23, which the shoelace 3 passes through and engages with.

The first eyelets 21*d* and 21*u* are provided along a side edge Pts of the second opening P2. The first eyelets 21*d* and 21*u* include toe-side first eyelets 21*d* placed near the toe T around the second opening P2, and ankle-side first eyelets 21*u* placed near an ankle Ak around the second opening P2.

The first eyelets 21*u* and 21*d* may be formed by punching circular through hole in the main upper 2M, or may be a strap formed in a loop which the shoelace 3 passes through as is a toe-side first eyelet 21*d* on the lateral side OUT.

The second eyelets 22 are provided along the side edge P2*s* of the second opening P2. The second eyelets 22 are placed in the middle between the toe-side first eyelets 21*d* and the ankle-side first eyelets 21*u*. As will be described later, the second eyelets 22 are formed by metal parts.

As shown in FIG. 4, the third eyelet 23 is provided at the upper end of each of the side panels 51 and 52.

The third eyelet 23 is formed by a folded piece of cloth whose opposite ends are sewn to a first surface 5*c* and a second surface 5*d* of the side panel 51, 52, and is formed in a loop so that the shoelace 3 can pass therethrough.

Side panels 51 and 52:

The side panels 51 and 52 include the first side panel 51 and the second side panel 52. As shown in FIGS. 5 and 6, the side panels 51 and 52 roll up from the sole 1 along the medial and lateral side surfaces S1 and S2, respectively, of the foot. Note that areas of the side panels 51 and 52 are dotted in FIGS. 2 to 6.

As shown in FIGS. 2 and 3, the side panels 51 and 52 are not surface-attached to the exterior material 12 of the main upper 2M. That is, the opposing surfaces of the side panel 51, 52 and the exterior material 12 are not surface-attached to each other, so that the first surface 5*c* of the side panel 51, 52 opposing the main upper 2M is allowed to come apart from the plane of the exterior material 12 of the main upper 2M for those areas dotted in FIGS. 5 and 6. As shown in FIGS. 5 and 6, lower ends 51*d* and 52*d* of the side panels 51 and 52 are bonded (sewn) to the sole 1.

The lower portion of the first surface 5*c* of the side panel 51, 52 is in contact with the inner surface of the exterior material 12 of the main upper 2M. The lower portion of the second surface 5*d* of the side panel 51, 52 is in contact with an arch Fr of the foot (FIGS. 5 and 6) in the absence of the exterior material 12 therebetween.

The first side panel 51, when tightened, extends in the upward direction Z1 along the medial side surface S1 of the foot in the space inside the main upper 2M so as to wrap around the medial side surface S1 of the foot. The second side panel 52, when tightened, extends in the upward direction Z1 along the lateral side surface S2 of the foot in the space inside the main upper 2M so as to wrap around the lateral side surface S2 of the foot.

In FIGS. 2 and 3, the side panels 51 and 52 are bent in the rearward direction Y2.

As shown in FIGS. 2 and 3, the side panels 51 and 52 are continuous and integral with the interior material 11. That is, an upper portion of a rear edge 5*b* of the side panel 51, 52 and a front edge 5*a* thereof are not attached to the main upper 2M, whereas a lower portion of the rear edge 5*b* of the side panel 51, 52 is attached to the main upper 2M.

The attachment forms first and second restriction means 10A and 10B, and the side panels 51 and 52 are bound to the main upper 2M by this attachment.

That is, when worn, the first restriction means 10A restricts the excessive tightening of the arch Fr on the medial side of the foot by the first side panel 51 being pulled toward the center of the foot via the shoelace 3. On the other hand, when worn, the second restriction means 10B restricts the excessive tightening of the arch Fr on the lateral side of the foot by the second side panel 52 being pulled toward the center of the foot via the shoelace 3.

FIG. 4 shows the shoe where the main upper 2M is bent so as to expand the second opening P2.

As shown in FIG. 4, the upper portions of the side panels 51 and 52 and the third eyelets 23 are placed between the tongue 4 and the main upper 2M. As shown in FIG. 1, the third eyelets 23 of the side panels 51 and 52 (FIG. 4) are exposed on the tongue 4 in the second opening P2 so as to be seen from the upward direction Z1.

As shown in FIG. 1, the third eyelet 23 of the first side panel 51 and the third eyelet 23 of the second side panel 52 are diagonally opposing each other across a virtual line L therebetween extending in the foot length direction Y.

As shown in FIG. 5, the first side panel 51 extends in the diagonally upward direction Z1 along the medial side surface S1 of the foot in the space inside the main upper 2M so as to wrap around the medial side surface S1 of the foot. The first side panel 51 covers the medial cuneiform bone $B5_1$ in an area in the forward direction Y1 of the navicular bone B6.

As shown in FIG. 6, the second side panel 52 extends in the diagonally upward direction Z1 along the lateral side surface S2 of the foot in the space inside the main upper 2M so as to wrap around the lateral side surface S2 of the foot. The second side panel 52 covers an area corresponding to the first side panel 51 and an area in the forward direction Y1 thereof. The second side panel 52 covers an area of and around the bases of the second to fifth metatarsal bones $B4_2$ to $B4_5$.

Therefore, the first and second side panels 51 and 52 are in contact with, and cover, the side surfaces of the arch Fr of the foot.

Figure 9:
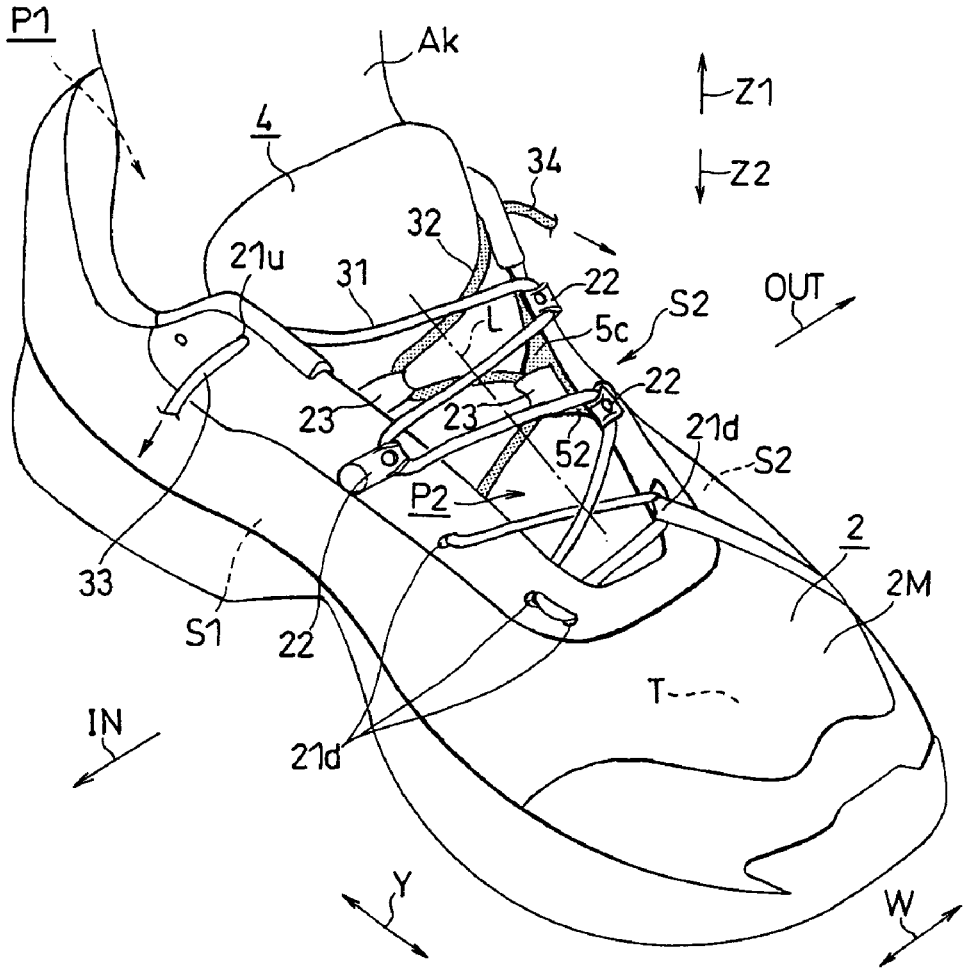
FIG. 9 is a schematic perspective view showing the shoe when the shoe is worn.

Shoelace 3:

As shown in FIG. 9, the shoelace 3 is formed by a single shoelace. Many protrusions (not shown) are formed around the shoelace.

The shoelace 3 passes through the first to third eyelets 21*d*, 21*u*, 22 and 23.

The shoelace 3 includes first to fourth portions 31 to 34. Note that the second portion 32 and the fourth portion 34 of the shoelace 3 are dotted in FIG. 9 for the sake of understanding. The third portion 33 and the fourth portion 34 of the shoelace 3 are partially omitted in the figures.

Figure 7A:
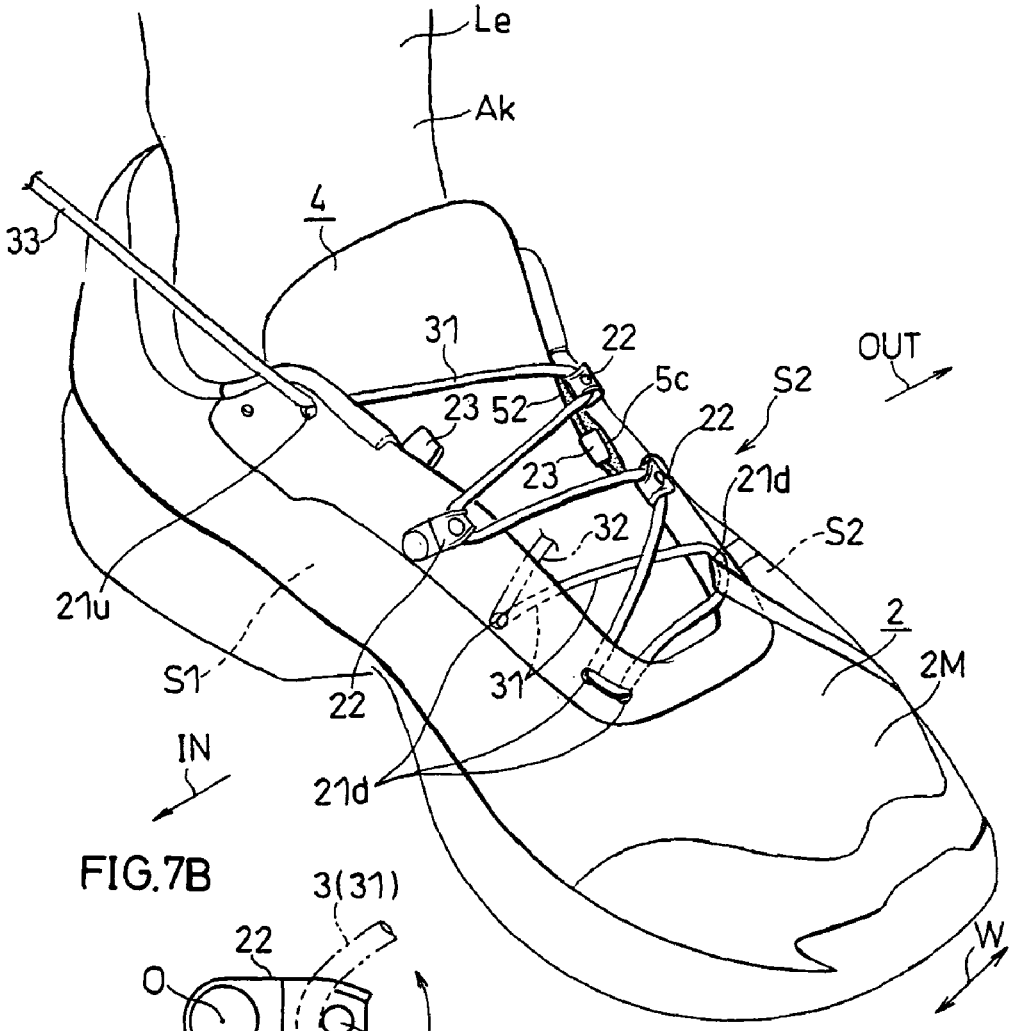
FIG. 7A is a schematic perspective view showing the shoe laced with the first portion and the third portion of the shoelace means.

As shown in FIG. 7A, the first portion 31 of the shoelace 3 does not pass through the third eyelets 23. The first portion 31 passes through the toe-side first eyelets 21*d*, the second eyelets 22 and the ankle-side first eyelet 21*u* so as to repeatedly reciprocate between the medial side surface S1 and the lateral side surface S2, i.e., so as to repeatedly diagonally cross the second opening P2.

As described above, the first eyelets 21*u* and 21*d* are formed by punching circular through holes in the main upper 2M. Since many protrusions are formed around the shoelace 3, the holes of the first eyelets 21*u* and 21*d* are engaged with the shoelace 3 to thereby increase the frictional force.

Figure 7B:
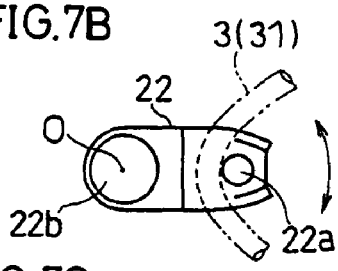
FIG. 7B is a schematic plan view showing an example of a second eyelet.
Figure 7C:
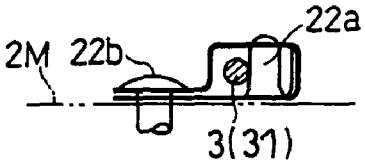
FIG. 7C is a schematic side view showing the example of the second eyelet.

On the other hand, metal second eyelets 22 shown in FIGS. 7B and 7C are used as the second eyelets 22.

As shown in FIGS. 7B and 7C, the second eyelet 22 includes a smooth cylindrical contact portion 22*a* with which the shoelace 3 comes into contact. Therefore, the frictional force between the metal contact portion 22*a* and the shoelace 3 is small, and the frictional force between the shoelace 3 and the second eyelet 22 is set to be smaller than the frictional force with the first eyelets 21*u* and 21*d*.

The second eyelet 22 is pivotally fixed to the main upper 2M via an anchor 22*b*. As the second eyelet 22 is pulled by the shoelace 3, the second eyelet 22 pivots on the pivot center O of the anchor 22*b* as indicated by an arrow.

Figure 8:
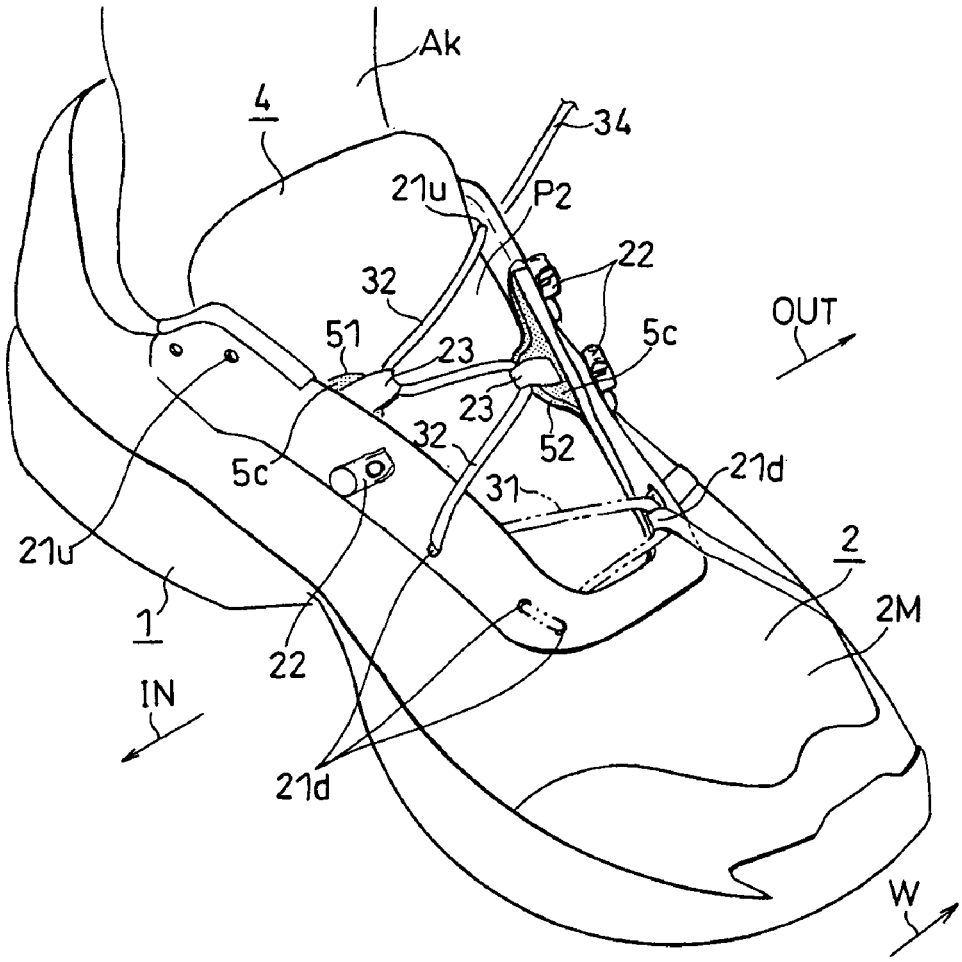
FIG. 8 is a schematic perspective view showing the shoe laced with the second portion and the fourth portion of the shoelace means.

As shown in FIG. 8, the second portion 32 of the shoelace 3 extends (passes through) from the toe-side first eyelet 21*d* around the second opening P2 to pass through the third eyelets 23 of both side panels 51 and 52 (FIGS. 5 and 6) without passing through the intermediate second eyelets 22. Moreover, the second portion 32 passes through the ankle-side first eyelet 21*u* around the second opening P2. Thus, the second portion 32 passes through the toe-side first eyelet 21*d*, the third eyelets 23 and 23 and the ankle-side first eyelet 21*u* so as to repeatedly diagonally cross the second opening P2.

As shown in FIG. 9, the third portion 33 of the shoelace 3 comes out through the ankle-side first eyelet 21*u* on the medial side IN.

The fourth portion 34 of the shoelace 3 comes out through the ankle-side first eyelet 21*u* on the lateral side OUT.

The third eyelets 23 are placed in the upward direction Z1 of the tongue 4 and in the downward direction Z2 of the first portion 31 of the shoelace 3 when tightened. The second portion 32 of the shoelace 3 passes through an area in the downward direction Z2 of the first portion 31.

Method of Adjustment:

After the shoelace 3 is passed through the first to third eyelets 21*u*, 21*d*, 22 and 23 as shown in FIG. 9, the third portion 33 and the fourth portion 34 of the shoelace 3 are tied (fastened) together.

Where one wishes to strongly tighten the arch Fr shown in FIGS. 5 and 6 while the toe T portion, etc., are allowed to move freely, the fourth portion 34 of the shoelace 3 is pulled while reducing the tension on the third portion 33 shown in FIG. 9.

As shown in FIG. 9, the third eyelet 23 of the first side panel 51 and the third eyelet 23 of the second side panel 52 are diagonally opposing each other across the virtual line L therebetween extending in the foot length direction Y. Therefore, as the fourth portion 34 is pulled, the side panels 51 and 52 of FIG. 4 come closer to each other via the pair of third eyelets 23 and 23 so as to fit the side panels 51 and 52 to the arch Fr of FIGS. 5 and 6, thereby tightening the arch Fr.

On the other hand, since the frictional force between the shoelace 3 and the second eyelet 22 of FIG. 9 is set to be smaller than the frictional force between the shoelace 3 and the first eyelet 21*u*, 21*d*, it is possible to easily loosen the tightening force on the medial side surface S1 and the lateral side surface S2 from the main upper 2M by slackening the third portion 33.

Where one wishes to fit the main upper 2M generally evenly across the entire foot, not only the fourth portion 34 of the shoelace 3 but also the third portion 33 thereof are pulled so that not only are the side panels 51 and 52 pulled toward each other, but also the medial side surface S1 and the lateral side surface S2 of the main upper 2M are pulled toward each other via the second eyelets, thereby fitting the side panels 51 and 52 and the main upper 2M across the entire foot.

Second Embodiment

Figure 11:
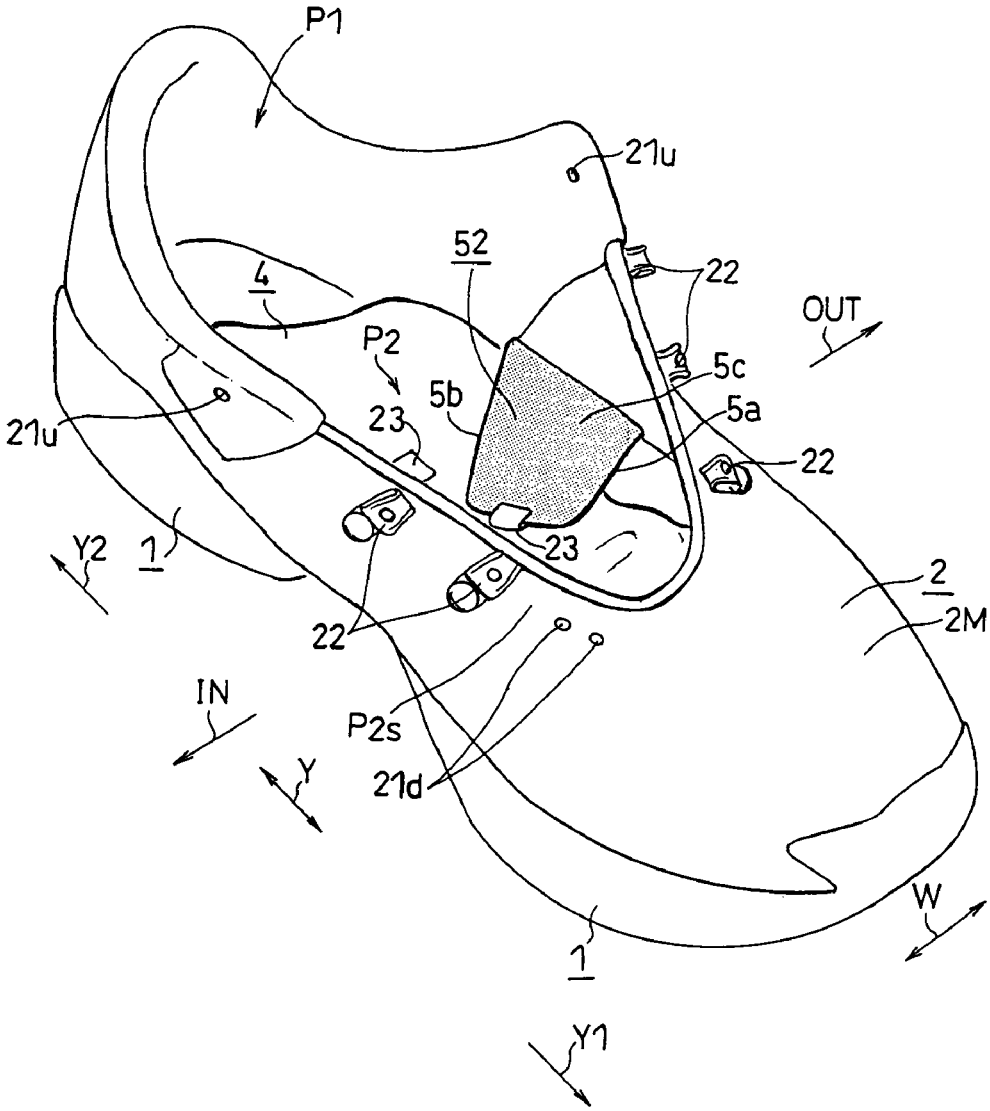
FIG. 11 is a schematic perspective view showing the shoe with shoelace means taken off.
Figure 12:
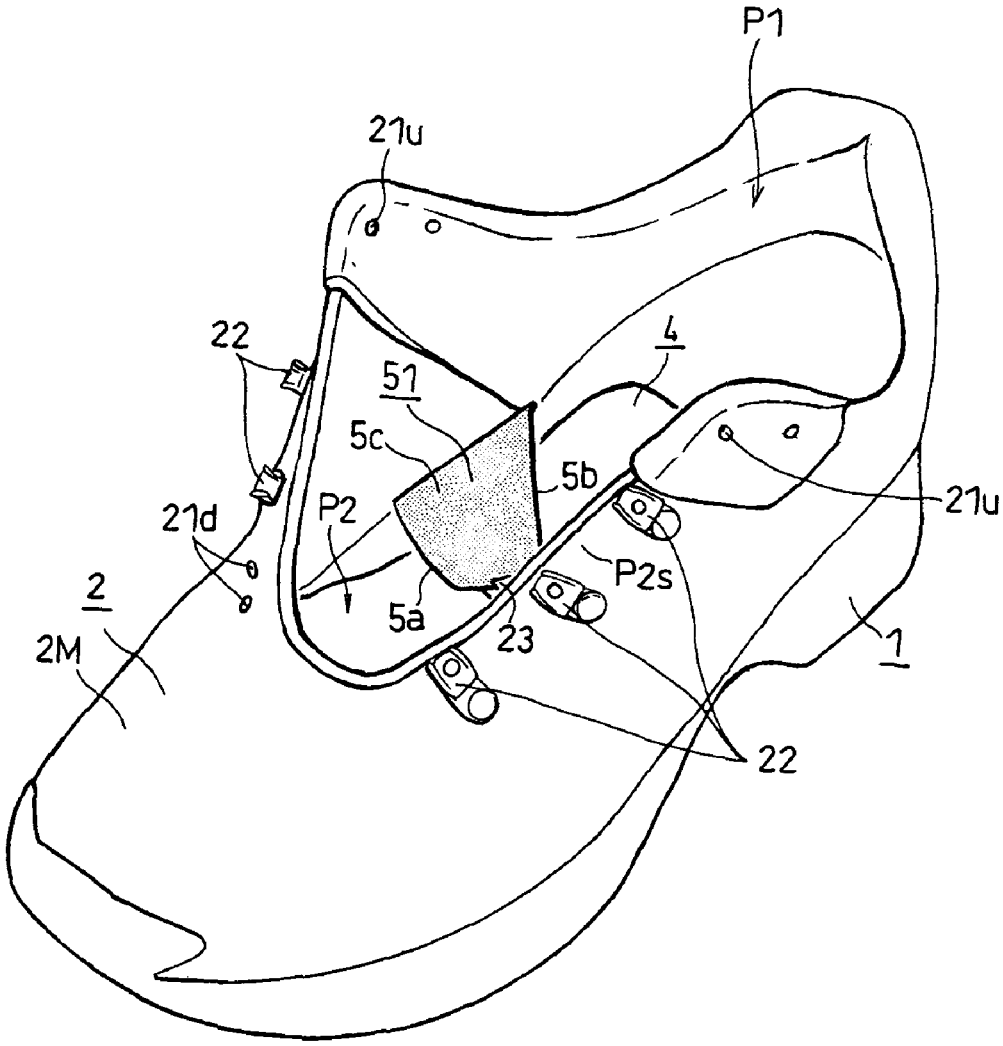
FIG. 12 is a schematic perspective view showing the shoe with shoelace means taken off.

A second embodiment of the present invention will now be described with reference to FIGS. 10 to 12.

Figure 10:
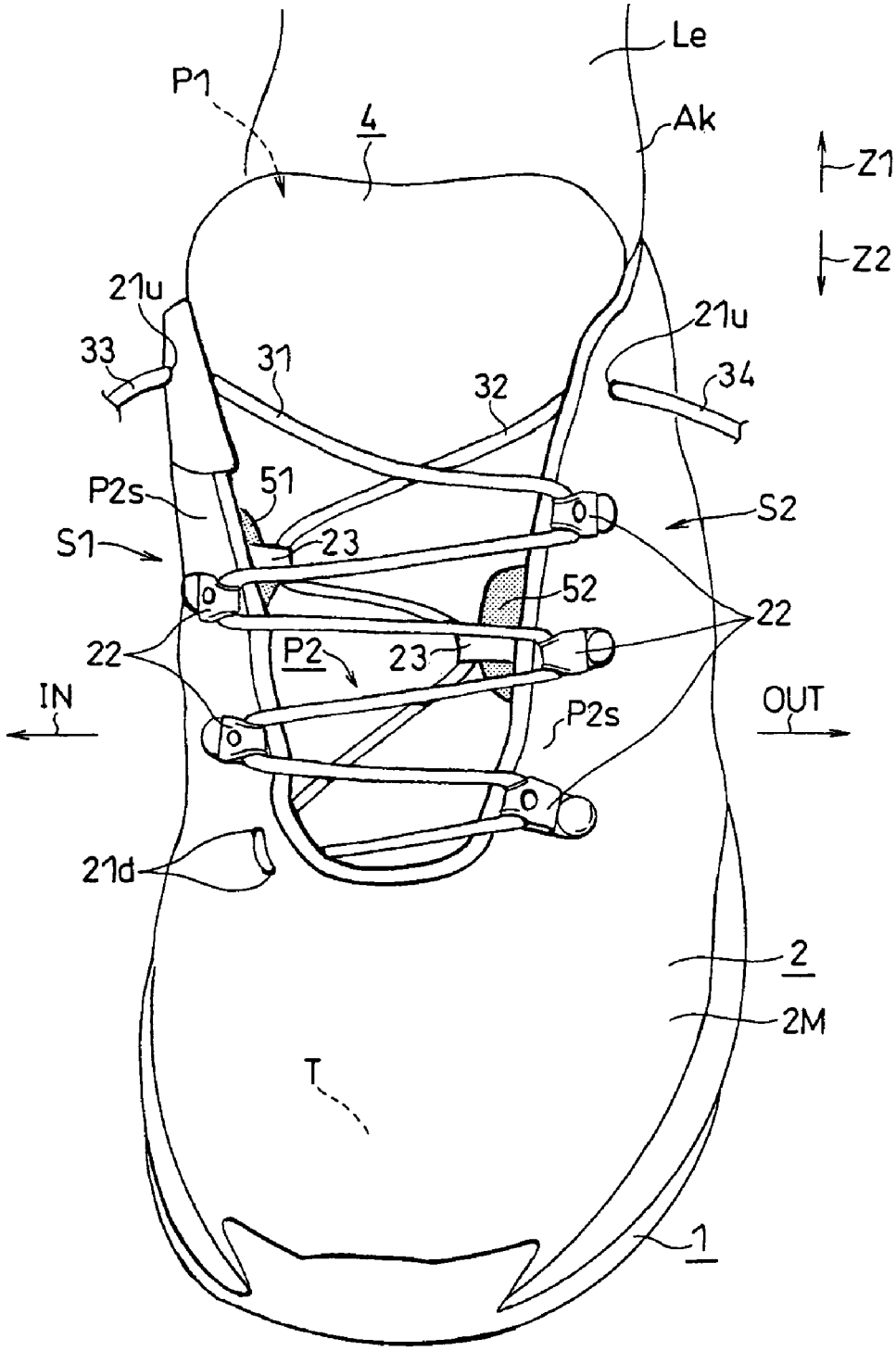
FIG. 10 is a schematic perspective view showing a shoe having a lace fitting structure according to a second embodiment of the present invention.

As shown in FIG. 10, a shoe of the second embodiment is provided with the first and second side panels 51 and 52. As shown in FIGS. 11 and 12, neither the front edge 5*a* nor the rear edge 5*b* of the side panel 51, 52 is attached to the main upper 2M in the upper portion or in the lower portion.

The configuration is otherwise similar to that of the first embodiment, and therefore will not be described below while using like reference numerals to denote like elements.

Third Embodiment

A third embodiment of the present invention will now be described with reference to FIGS. 13A and 13B.

Figure 13A:
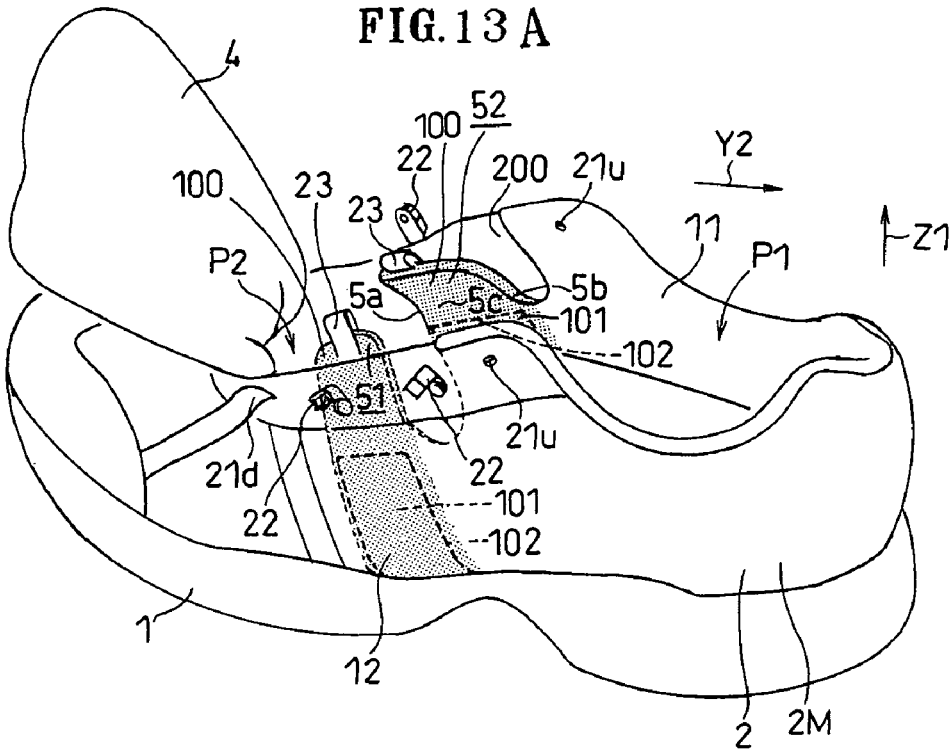
FIGS. 13A and 13B are schematic perspective views each showing a shoe having a lace fitting structure according to a third embodiment of the present invention with the shoelace taken off.
Figure 13B:
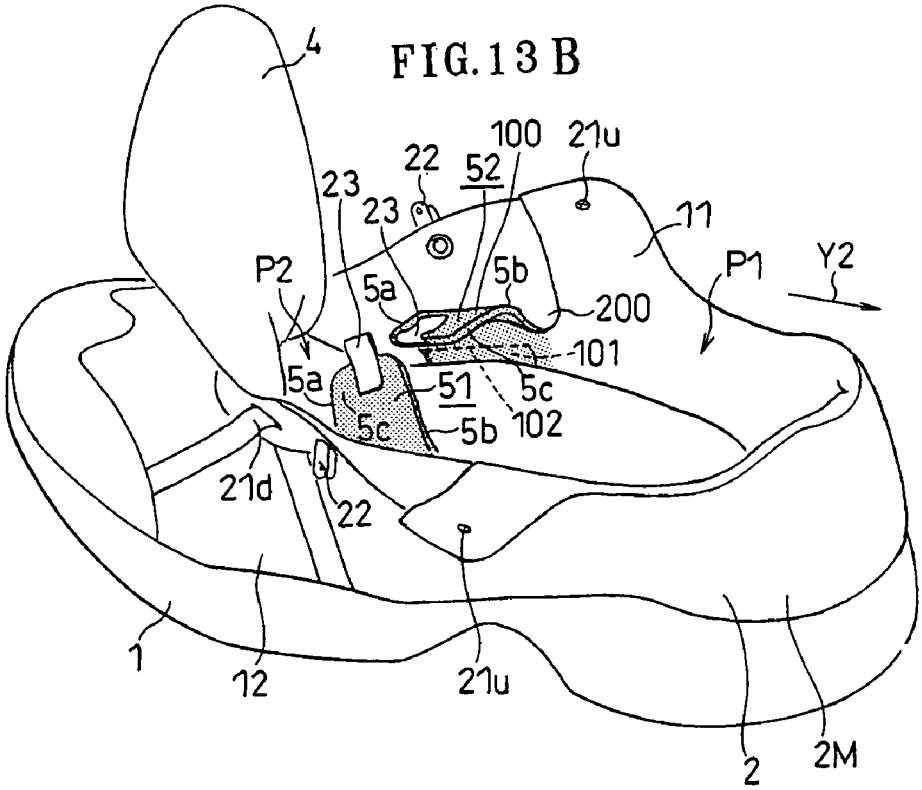

As shown in FIGS. 13A and 13B, the main upper 2M of the third embodiment is provided with U-shaped notch portions 200 in the rearward direction Y2 of the first and second side panels 51 and 52. The rear edge of the side panel 51, 52 is bound to the main upper 2M by being continuous with the interior material 11. As the side panel 51, 52, a synthetic leather backing, which is different from the interior material 11, may be bonded to the interior material 11.

The entire surface of an upper portion 100 of the side panel 51, 52, where the third eyelet 23 is provided, is not attached to the exterior material 12 of the main upper 2M. Therefore, the upper portion 100 can fit to the side surface or the instep of the foot while being spaced apart from the exterior material 12.

On the other hand, the side panel 51, 52 is sewn and attached to the exterior material 12 with a thread 102 along a lower portion of the front edge 5*a*, a lower portion of the rear edge 5*b*, and a vertically intermediate portion, as indicated by a thick broken line. Therefore, a lower portion 101 of the side panel 51, 52 is attached to the exterior material 12, and thus fits to a side surface of the foot or opposes a side surface of the foot while being spaced apart therefrom, without coming off of the exterior material 12.

The configuration is otherwise similar to that of the first embodiment, and therefore will not be described below while using like reference numerals to denote like elements.

Fourth Embodiment

A fourth embodiment of the present invention will now be described with reference to FIGS. 14A to 15B.

Figure 14A:
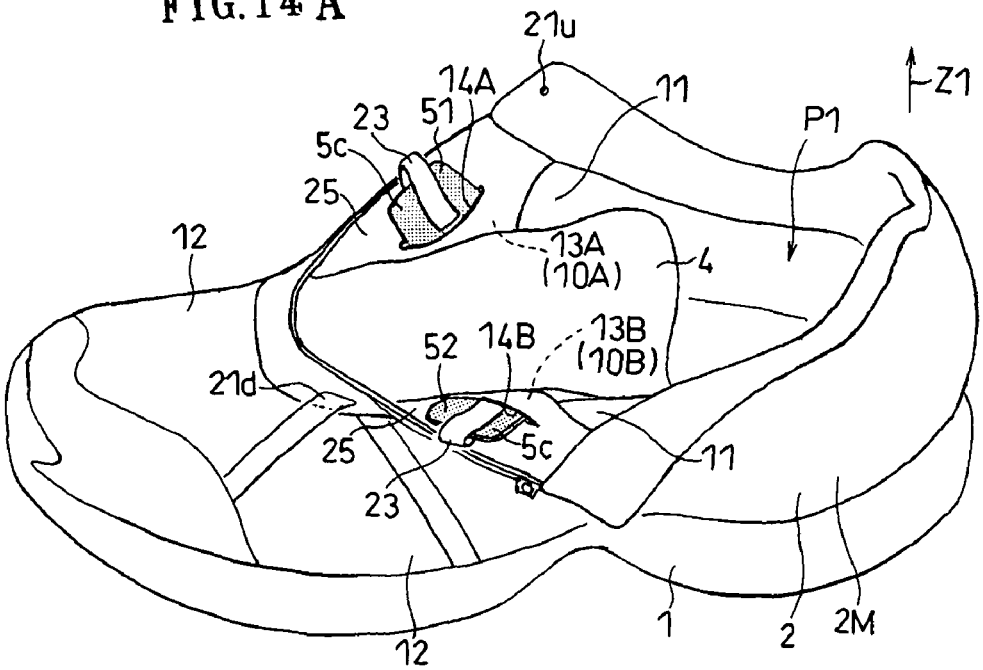
FIGS. 14A and 14B are schematic perspective views each showing a shoe having a lace fitting structure according to a fourth embodiment of the present invention with the shoelace taken off.
Figure 14B:
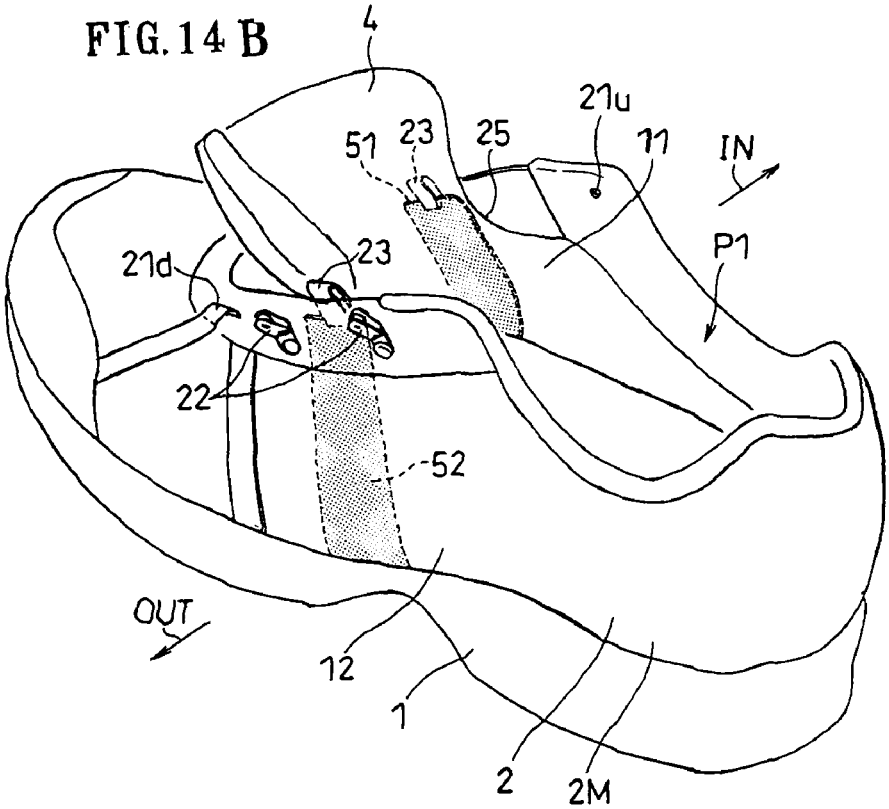

As shown in FIG. 14A, in a shoe of the fourth embodiment, the opposite side portions of the tongue 4 are each attached to the main upper 2M via an attachment member 25.

With the attachment member 25, it is possible to prevent sand, rain, muddy water, etc., from entering the shoe through the gap between the tongue 4 and the main upper 2M.

For example, a water-repellant, air-permeable material is preferably used for the attachment member 25.

In the present embodiment, the interior material 11 is continuous with the inner surface of the attachment member 25 and the inner surface of the tongue 4 while generally covering the entire surface of the foot. In the arch Fr area on the medial side and the lateral side of the foot, sack-like first and second sack portions 13A and 13B are formed, in which the interior material 11 and the exterior material 12 are not surface-attached to each other.

Figure 15A:
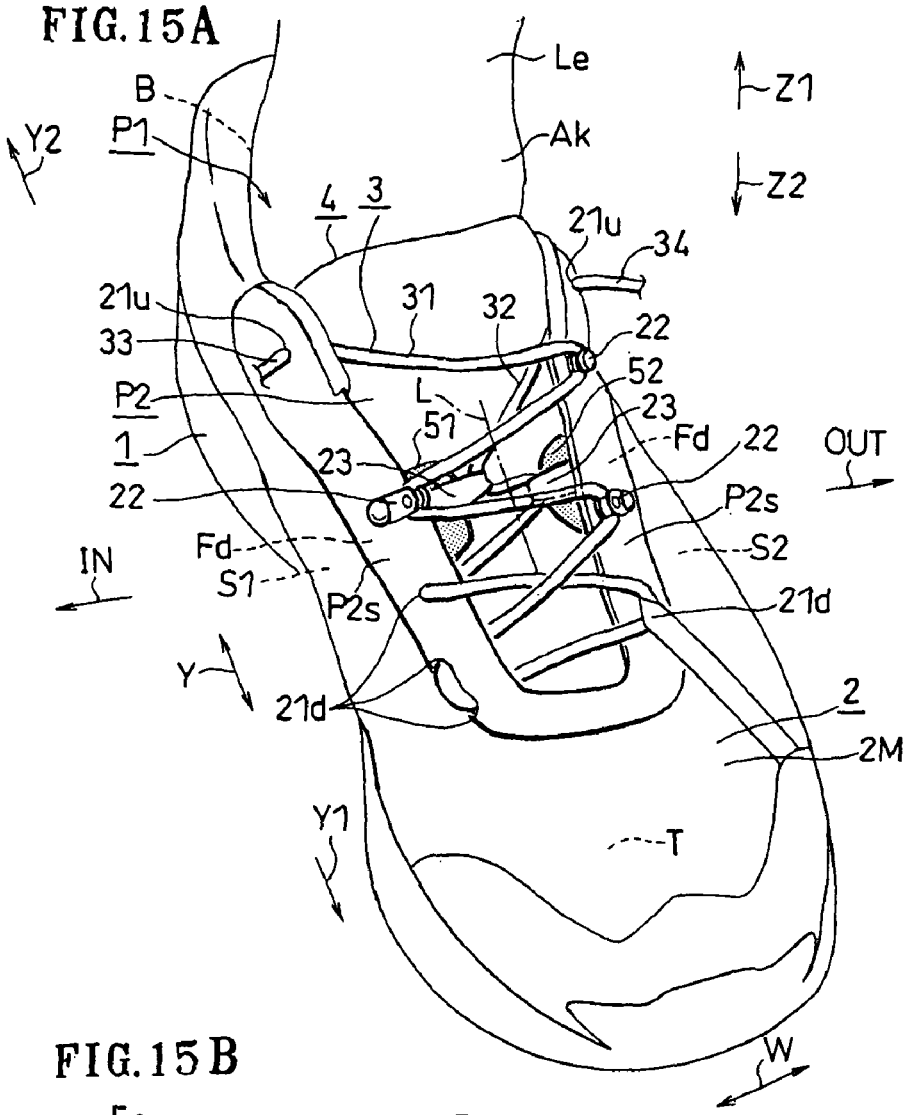
FIG. 15A is a schematic perspective view showing the shoe of this embodiment as viewed from the front side.
Figure 15B:
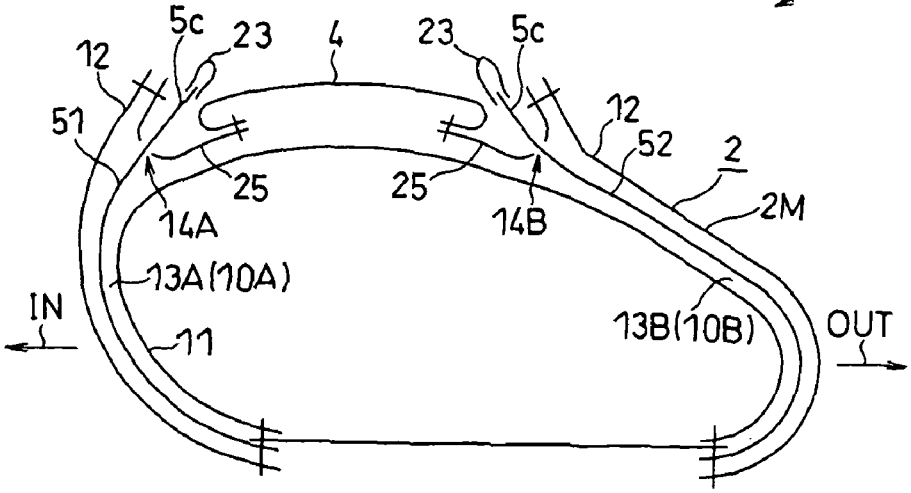
FIG. 15B is a conceptual cross-sectional view showing the shoe.

As shown in FIG. 15B, in the sack portion 13A, 13B, the side panel 51, 52 is placed at a position sandwiched between the interior material 11 and the exterior material 12.

The first and second sack portions 13A and 13B have first and second slits 14A and 14B, respectively, through which the space inside the upper is exposed. The first sack portion 13A accommodates the lower portion of the first side panel 51, with the upper portion of the first side panel 51 coming out of the first slit 14A. The second sack portion 13B accommodates the lower portion of the second side panel 52, with the upper portion of the second side panel 52 coming out of the second slit 14B.

The length of the slit 14A, 14B is slightly larger than the width of the side panel 51, 52 in the front-rear direction. Therefore, the slit 14A, 14B restricts the shifting of the side panel 51, 52 in the front-rear direction.

The lower portion of the side panel 51, 52 is accommodated in the sack portion 13A, 13B. Therefore, when the side panels 51 and 52 are tightened by the shoelace 3 and the side panels 51 and 52 are pulled toward the center of the foot as shown in FIG. 15A, the interior material 11 of FIG. 14A restricts the movement of the lower portion of the side panel 51, 52. That is, in the present embodiment, the first and second sack portions 13A and 13B form the first and second restriction means 10A and 10B.

While the slits 14A and 14B are provided in the attachment member 25 in the case of the present embodiment, they may be provided in the interior material 11 instead of in the attachment member 25. For example, where the attachment member 25 is not provided, and the interior material 11 is provided on the inner surface of the exterior material 12, the side panels 51 and 52 may come out from the sack portions between the interior material 11 and the exterior material 12 via the slits provided in the interior material 11.

In FIG. 15A, the pair of side panels 51 and 52 are provided at positions facing each other. That is, the first and second side panels 51 and 52 are provided at the same position in the foot length direction.

The configuration is otherwise similar to that of the first embodiment, and therefore will not be described below while using like reference numerals to denote like elements.

While preferred embodiments have been described above with reference to the drawings, various obvious changes and modifications will readily occur to those skilled in the art upon reading the present specification.

For example, the second side panel may be located at a position facing the first side panel or forward or backward of that position.

Two or more second eyelets may be provided in each side panel.

There may be two or more shoelaces 3.

The lower end of the side panel may not be bonded to the sole. The tongue may not be provided. Where the tongue is not provided, a comb-shaped panel may be provided both on the medial side surface and on the lateral side surface, for example, so that the first side panel and the second side panel together cover the instep in an alternating pattern.

Thus, such changes and modifications are deemed to fall within the scope of the present invention, which is defined by the appended claims.

INDUSTRIAL APPLICABILITY

The present invention is applicable to athletic shoes, such as trekking shoes, and also to various other types of shoes.

What is claimed is:

1. A shoe having a lace fitting structure, comprising:

a sole for absorbing an impact of landing, an upper for wrapping around an instep, and shoelace means for fitting the upper to the instep, wherein the upper defines a first opening through which a leg comes out in an upward direction during wearing, and a second opening provided on a front of the first opening, the two openings being continuous with each other in a front-rear direction, the upper comprising:

a main upper covering a medial side surface, a lateral side surface, a toe and a back surface of a foot;

a plurality of first eyelets provided along a side edge of the second opening, wherein the shoelace means passes through and engages with the first eyelets, and the first eyelets include at least one of the first eyelets placed near the toe around the second opening and at least one of the first eyelets placed near an ankle around the second opening;

a plurality of second eyelets provided along the side edge of the second opening, wherein the shoelace means passes through and engages with the second eyelets, and the second eyelets are placed between the at least one first eyelet near the toe around the second opening and the at least one first eyelet near the ankle around the second opening;

a first side panel extending in an upward or diagonally upward direction along the medial side surface in a space inside the main upper so as to wrap around the medial side surface of the foot;

a second side panel extending in the upward or diagonally upward direction along the lateral side surface in the space inside the main upper so as to wrap around the lateral side surface of the foot; and a third eyelet provided at a tip of each of the first and second side panels, wherein the shoelace means passes through and engages with the third eyelet, wherein:

at least an upper portion of each of the side panels including an area thereof where the third eyelet is provided is unattached to the main upper; and a frictional force between the shoelace means and the second eyelets is smaller than a frictional force between the shoelace means and the first eyelets, the shoelace means including:

a first portion passing through the first and second eyelets so as to repeatedly reciprocate between the medial side surface and the lateral side surface without passing through the third eyelets, thereby narrowing the second opening in a foot breadth direction and fitting the main upper to the foot; and a second portion passes through from the at least one first eyelet near the toe around the second opening to the third eyelet of each of the side panels without passing through the second eyelets and further through the at least one first eyelet near the ankle around the second opening, thereby fitting the first and second side panels to the medial and lateral side surfaces of the foot.

2. A shoe according to claim 1, wherein:

the main upper further comprises an interior material covering at least a rear foot portion of the foot and being in contact with a foot surface, and an exterior material covering an entirety from the toe to the rear foot portion and covering the interior material from outside; and a lower portion of each of the side panels is placed between the interior material and the exterior material.

3. A shoe according to claim 1, wherein a lower end of each of the side panels is attached to the main upper and/or the sole, and an upper portion of a rear edge of each of the side panels and an upper portion of a front edge of each of the side panels are unattached to the main upper, with a lower portion of the rear edge and/or the front edge of each of the side panels being attached to the main upper.

4. A shoe according to claim 1, wherein each of the side panels is not surface-attached to the main upper, and a lower end of each of the side panels is bonded to the main upper and/or the sole, with neither a front edge nor a rear edge of each of the side panels being attached to the main upper.

5. A shoe according to claim 1, wherein:

the shoelace means further includes a third portion coming out through the at least one first eyelet near the ankle on a medial side, and a fourth portion coming out through the at least one first eyelet near the ankle on a lateral side; and the third portion and the fourth portion are fasten able together near the ankle.

6. A shoe according to claim 5, wherein the shoelace means comprises a single shoelace.

7. A shoe according to claim 1, further comprising a tongue closing the second opening from a downward direction, wherein:

a lower portion of each of the first and second side panels has a first surface in contact with an inner surface of the main upper and a second surface in contact with an arch of the foot;

the upper portion of each of the first and second side panels is placed between the tongue and the main upper; and the third eyelet is exposed on the tongue, extending in an upward direction from the second opening.

8. A shoe according to claim 1, wherein the first side panel rolls up from the sole along the medial side surface of the foot and the second side panel rolls up from the sole along the lateral side surface of the foot.

9. A shoe according to claim 1, further comprising a tongue closing the second opening from a downward direction, wherein:

the third eyelet is provided so as to lie above the tongue and below the first portion of the shoelace means when the shoe is tightened with the shoelace means; and the second portion passes below the first portion of the shoelace means.

10. A shoe according to claim 1, wherein the third eyelet of the first side panel and the third eyelet of the second side panel are located so as to be obliquely opposed to each other across a virtual line therebetween extending in a foot length direction.

11. A shoe according to claim 1, wherein:

the first side panel covers at least a portion of a medial cuneifoi n bone in an area in front of a navicular bone; and the second side panel covers the foot at least one of a position facing the first side panel, a position forward thereof and a position backward thereof.

12. A shoe having a lace fitting structure, comprising:

a sole for absorbing an impact of landing, an upper for wrapping around an instep, and shoelace means for fitting the upper to the instep, wherein the upper defines a first opening through which a leg comes out in an upward direction during wearing, and a second opening provided on a front of the first opening, the two openings being continuous with each other in a front-rear direction, the upper comprising:

a main upper covering a medial side surface, a lateral side surface, a toe and a back surface of a foot;

a plurality of first eyelets provided along a side edge of the second opening, wherein the shoelace means passes through and engages with the first eyelets, and the first eyelets include at least one of the first eyelets placed near the toe around the second opening and at least one of the first eyelets placed near an ankle around the second opening;

a plurality of second eyelets provided along the side edge of the second opening, wherein the shoelace means passes through and engages with the second eyelets, and the second eyelets are placed between the at least one first eyelet near the toe around the second opening and the at least one first eyelet near the ankle around the second opening;

a first side panel extending in an upward or diagonally upward direction along the medial side surface in a space inside the main upper so as to wrap around the medial side surface of the foot;

a second side panel extending in the upward or diagonally upward direction along the lateral side surface in the space inside the main upper so as to wrap around the lateral side surface of the foot; and a third eyelet provided at a tip of each of the first and second side panels, wherein the shoelace means passes through and engages with the third eyelet;

at least an upper portion of each of the side panels including an area thereof where the third eyelet is provided is unattached to the main upper;

the third eyelets of the first side panel and the third eyelet of the second side panel are located so as to be obliquely opposed to each other across a virtual line therebetween extending in a foot length direction; and the shoelace means passes continuously through the third eyelet of the first side panel and the third eyelet of the second side panel.

13. A shoe according to claim 12, wherein a lower end of each of the side panels is attached to the upper and/or the sole.

14. A shoe according to claim 13, wherein an upper portion of a rear edge of each of the side panels and an upper portion of a front edge of each of the side panels are unattached to the main upper, and a lower portion of the rear edge and/or the front edge of each of the side panels is attached to the main upper.

15. A shoe according to claim 13, wherein neither a front edge nor a rear edge of each of the side panels is attached to the main upper.

16. A shoe having a lace fitting structure, comprising:

a sole for absorbing an impact of landing, an upper for wrapping around an instep, and shoelace means for fitting the upper to the instep, wherein the upper defines a first opening through which a leg comes out in an upward direction during wearing, and a second opening being closed by a tongue covering the instep, the two openings being continuous with each other in a front-rear direction, the upper comprising:

a main upper covering a medial side surface, a lateral side surface, a toe and a back surface of a foot;

a plurality of first eyelets provided along a side edge of the second opening, wherein the shoelace means passes through and engages with the first eyelets, and the first eyelets include at least one of the first eyelets placed near the toe around the second opening and at least one of the first eyelets placed near an ankle around the second opening;

a plurality of second eyelets provided along the side edge of the second opening, wherein the shoelace means passes through and engages with the second eyelets, and the second eyelets are placed between the at least one first eyelet near the toe around the second opening and the at least one first eyelet near the ankle around the second opening;

a first side panel extending in an upward or diagonally upward direction along the medial side surface in a space inside the main upper so as to wrap around the medial side surface of the foot;

a second side panel extending in the upward or diagonally upward direction along the lateral side surface in the space inside the main upper so as to wrap around the lateral side surface of the foot; and a third eyelet provided at a tip of each of the first and second side panels, wherein the shoelace means passes through and engages with the third eyelet;

the first and second side panels are in contact with an inner surface of the main upper;

a lower portion of each of the first and second side panels is in contact with an arch of the foot;

at least an upper portion of each of the side panels including an area thereof where the third eyelet is provided is unattached to the main upper;

the upper portion of each of the side panels is placed between the tongue and the main upper; and the third eyelet is exposed on the tongue, extending in an upward direction from the second opening, wherein the shoelace means includes:

a first portion passing through the first and second eyelets so as to repeatedly reciprocate between the medial side surface and the lateral side surface without passing through the third eyelets, thereby narrowing the second opening in a foot breadth direction and fitting the medial side portion and the lateral side portion to the foot; and a second portion passing through from the at least one first eyelet near the toe around the second opening to the third eyelets of both side panels without passing through the second eyelets and further through the at least one first eyelet near the ankle around the opening, thereby fitting the first and second side panels to the lateral and medial side surfaces of the foot.

17. A shoe according to claim 16, wherein:

the third eyelet is provided so as to lie above the tongue and below the first portion of the shoelace means when the shoe is tightened; and the second portion of the shoelace means passes below the first portion of the shoelace means.

18. A shoe having a lace fitting structure, comprising:

a sole for absorbing an impact of landing, an upper for wrapping around an instep, and shoelace means for fitting the upper to the instep, wherein the upper defines a first opening through which a leg comes out in an upward direction during wearing, and a second opening provided on a front of the first opening, the two openings being continuous with each other in a front-rear direction, the upper comprising:

a main upper covering a medial side surface, a lateral side surface, a toe and a back surface of a foot;

a first side panel extending in an upward or diagonally upward direction along the medial side surface from a medial arch of the foot so as to wrap around the medial side surface of the foot; and a second side panel extending in the upward or diagonally upward direction along the lateral side surface from a lateral arch of the foot so as to wrap around the lateral side surface of the foot, wherein:

the main upper comprises an interior material covering at least a rear foot portion of the foot and being in contact with a foot surface, and an exterior material covering an entirety from the toe to the rear foot portion and covering the interior material from outside;

each of the side panels is placed in an inner space formed by the exterior material and the interior material, and is tightened by the shoelace means during wearing so as to be in contact with the foot surface via the interior material in the absence of the exterior material therebetween; and an upper portion of each of the side panels is unattached to the exterior material, the shoe further comprising:

first restriction means for restricting the tightening of the first side panel on the medial arch by means of the shoelace means during wearing; and second restriction means for restricting the tightening of the second side panel on the lateral arch by means of the shoelace means during wearing.

19. A shoe according to claim 18, wherein:

a lower end of each of the side panels is fixed to the upper and/or the sole; and an upper portion of a rear edge of each of the side panels and an upper portion of a front edge of each of the side panels are unattached to the main upper, and a lower portion of the rear edge and/or the front edge of each of the side panels is attached to the main upper, wherein the first and second restriction means are formed by such attachment.

20. A shoe according to claim 18, wherein:

the interior material and the exterior material together form a sack-like first sack portion where the interior material and the exterior material are not surface-attached to each other in an area of the medial side surface of the foot, and a sack-like second sack portion where the interior material and the exterior material are not surface-attached to each other in an area of the lateral side surface of the foot;

the first and second sack portions have first and second slits, respectively, through which the inner space is exposed;

the first sack portion accommodates a lower portion of the first side panel, with the upper portion of the first side panel coming out of the first slit; and the second sack portion accommodates a lower portion of the second side panel, with the upper portion of the second side panel coming out of the second slit.

21. A shoe having a lace fitting structure, comprising:

a sole for absorbing an impact of landing, an upper for wrapping around an instep, and shoelace means for fitting the upper to the instep, wherein the upper defines a first opening through which a leg comes out in an upward direction during wearing, and a second opening provided on a front of the first opening, the two openings being continuous with each other in a front-rear direction, the upper comprising:

a main upper covering a medial side surface, a lateral side surface, a toe and a back surface of a foot;

a first side panel extending in an upward or diagonally upward direction along the medial side surface from a medial arch of the foot so as to wrap around the medial side surface of the foot; and a second side panel extending in the upward or diagonally upward direction along the lateral side surface from a lateral arch of the foot so as to wrap around the lateral side surface of the foot, wherein:

the main upper comprises an interior material covering at least a rear foot portion of the foot and being in contact with a foot surface, and an exterior material covering an entirety from the toe to the rear foot portion and covering the interior material from outside; and each of the side panels is placed in an inner space formed by the exterior material, and an upper portion of each of the side panels is unattached to the exterior material, whereby each of the side panels is tightened by the shoelace means during wearing so that the upper portion of each of the side panels is in contact with the foot surface in the absence of the exterior material there between, the shoe further comprising:

first restriction means for restricting the tightening of the first side panel on the medial arch by means of the shoelace means during wearing; and second restriction means for restricting the tightening of the second side panel on the lateral arch by means of the shoelace means during wearing.

22. A shoe according to claim 21, wherein:

a lower end of each of the side panels is fixed to the upper and/or the sole; and an upper portion of a rear edge of each of the side panels and an upper portion of a front edge of each of the side panels are unattached to the main upper, and a lower portion of the rear edge and/or the front edge of each of the side panels is attached to the main upper, wherein the first and second restriction means are formed by such attachment.

* * * * *